US005719349A

United States Patent [19]

Canaday et al.

[11] Patent Number: 5,719,349

[45] Date of Patent: Feb. 17, 1998

[54] SHOULDER-LAUNCHED MULTI-PURPOSE ASSAULT WEAPON WITH A REMOVABLE ROCKET TUBE AND SPOTTER BARREL

[75] Inventors: Michael M. Canaday, King George; Fred W. Watson, Jr., Montross, both of Va.

[73] Assignee: The United States of America as represented by the Secretary of the Navy, Washington, D.C.

[21] Appl. No.: 599,391

[22] Filed: Dec. 8, 1995

[51] Int. Cl.[6] ..... F41F 3/045

[52] U.S. Cl. ..... 89/1.816; 42/75.02

[58] Field of Search ..... 89/1.41, 1.7, 1.816, 89/1.815; 42/75.01, 75.02

[56] References Cited

U.S. PATENT DOCUMENTS

| | | | |
|---|---|---|---|
| 1,479,840 | 1/1924 | Stone | 89/1.41 |
| 2,030,312 | 2/1936 | Mossberg | 42/100 |
| 2,949,825 | 8/1960 | Musser et al. | 89/1.41 |
| 3,098,410 | 7/1963 | Giza | 89/1.7 |
| 3,368,454 | 2/1968 | Peck et al. | 89/14 |
| 3,494,249 | 2/1970 | Choate | 89/1.816 |
| 3,507,067 | 4/1970 | Into | 42/75.02 |
| 3,766,828 | 10/1973 | Cords | 89/1.8 |
| 3,955,299 | 5/1976 | Bullis | 42/75.01 |
| 4,038,902 | 8/1977 | Welsh | 89/1.807 |
| 4,195,432 | 4/1980 | Hickman | 42/75.01 |
| 4,593,602 | 6/1986 | Faix | 89/1.816 |
| 4,685,235 | 8/1987 | Bunning et al. | 42/75.02 |
| 4,843,946 | 7/1989 | Gladstone et al. | 89/15 |
| 4,920,679 | 5/1990 | Sarles et al. | 42/75.02 |
| 5,155,284 | 10/1992 | Flashkes | 42/75.02 |
| 5,531,039 | 7/1996 | Gore | 42/101 |
| 5,540,008 | 7/1996 | Kirnstatter | 42/75.02 |

OTHER PUBLICATIONS

Fundamental of Small Arms, U.S. Army Ordnance Center and School, p. 25, Oct. 1988.

*Primary Examiner*—Michael J. Carone
*Assistant Examiner*—Christopher K. Montgomery
*Attorney, Agent, or Firm*—James B. Bechtel, Esq.

[57] ABSTRACT

A shoulder-launched multi-purpose assault weapon with a removable rocket tube and spotter barrel is provided. The rocket tube and spotter barrel assembly is a standard receiver and trigger assembly. The grouping of the tube and barrel in a single removable assembly allows quick field replacement for either repair or reconfiguration of the weapon to a different rocket size. The sight assembly is also removable by sliding the sight out of dovetail attachment points. A further benefit is that different rocket tube assemblies may be pre-boresighted at the factory, thereby also reducing field assembly time.

6 Claims, 4 Drawing Sheets

SHOULDER-LAUNCHED MULTI-PURPOSE ASSAULT WEAPON WITH A REMOVABLE ROCKET TUBE AND SPOTTER BARREL

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention is related to the technical field of assault weapons and in particular to shoulder-launched rocket weapons.

BACKGROUND OF THE INVENTION

Shoulder-launched assault weapons are well-known in the art. A typical configuration has a rocket launcher tube used as a mounting platform for a sighting scope, handles and firing components for the weapon, and a spotter rifle. A disadvantage of this configuration is that replacement of the rocket launcher tube requires the removal and reattachment of a large number of components. Additionally, the rocket launcher tube typically has a relatively short useful lifetime due to the requirement for a lightweight tube coupled with the erosive effects of the rocket discharge. A second component which may require replacement is the spotter rifle barrel. The spotter rifle barrel may be changed either because of wear or because a different round is required (with different ballistics). Likewise, the rocket tube must be changed, if it is necessary to change rocket rounds. What is needed is an assault weapon having easily interchangeable components for both the spotter rifle and rocket tube.

SUMMARY OF THE INVENTION

It is an object of the invention to provide a shoulder-launched multi-purpose assault weapon having a removable rocket tube.

It is yet another object of the invention to provide a shoulder-launched multi-purpose assault weapon having a removable spotter rifle barrel.

It is yet another object of the invention to provide a shoulder-launched multi-purpose assault weapon having a spotter rifle as the base for attachment of other weapon components.

The invention is a shoulder-launched multi-purpose assault weapon with a removable rocket tube and spotter barrel. The rocket tube and spotter barrel assembly is a standard receiver and trigger assembly. The grouping of the tube and barrel in a single removable assembly allows quick field replacement for either repair or reconfiguration of the weapon to a different rocket size. The sight assembly is also removable by sliding the sight out of dovetail attachment points. A further benefit is that different rocket tube assemblies may be pre-boresighted at the factory, thereby also reducing field assembly time.

BRIEF DESCRIPTION OF THE DRAWINGS

The foregoing objects and other advantages of the present invention will be more fully understood from the following detailed description and reference to the appended drawings wherein.

DETAILED DESCRIPTION OF THE INVENTION

Figure 1:
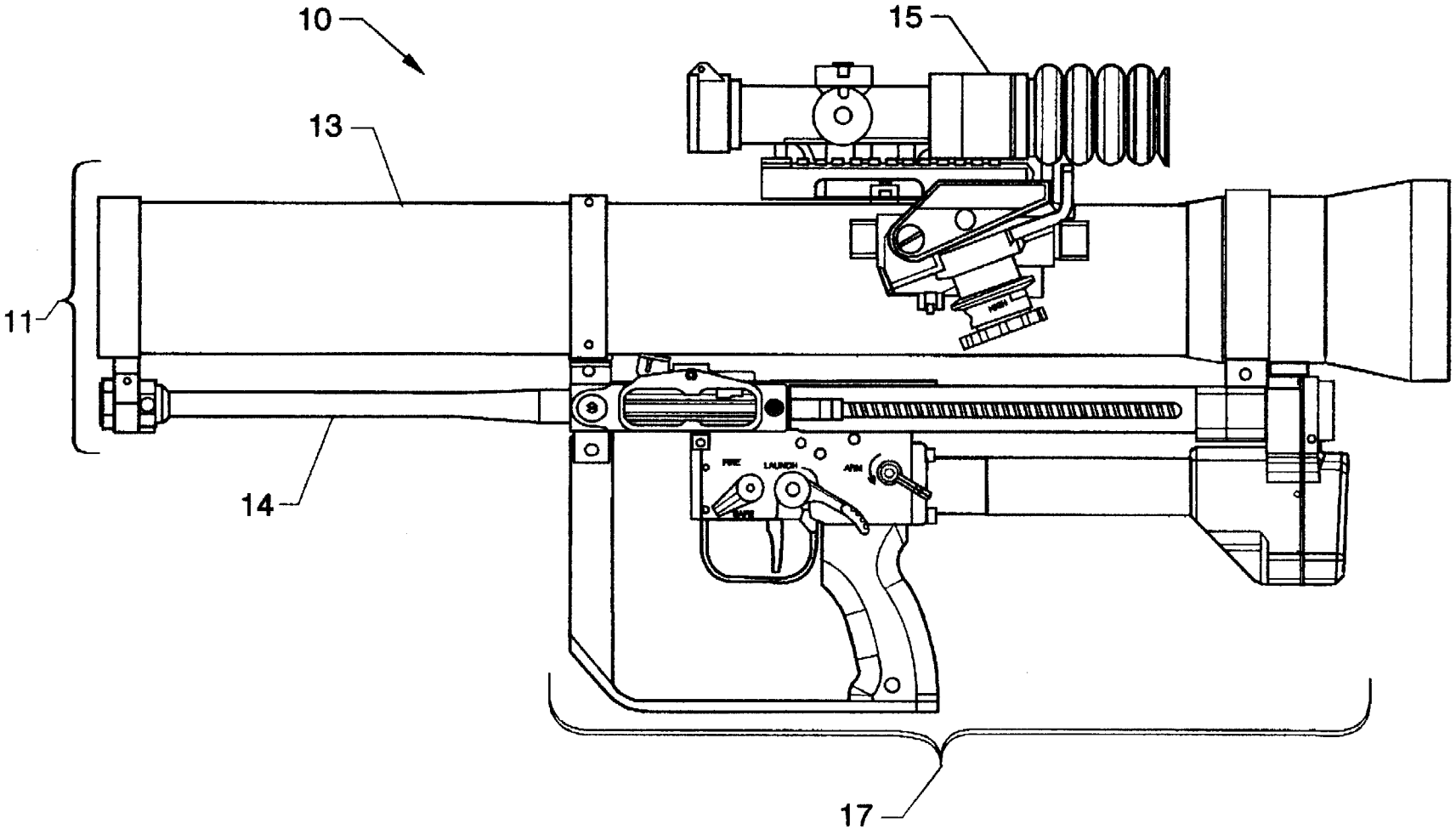
FIG. 1 is a side view of the shoulder-launched multi-purpose assault weapon.

Referring now to FIG. 1, the overall shoulder-launched multi-purpose assault weapon, designated generally by the reference numeral 10, is shown with its major components. The shoulder-launched multi-purpose assault weapon comprises two major subassemblies, the removable tube and barrel assembly 11 and the receiver and trigger assembly group 17. The tube and barrel assembly 11 includes the rocket launcher tube 13 and the spotter rifle barrel 14. A removable telescopic sight 15 is attached to the rocket launcher tube 13.

Figure 2:
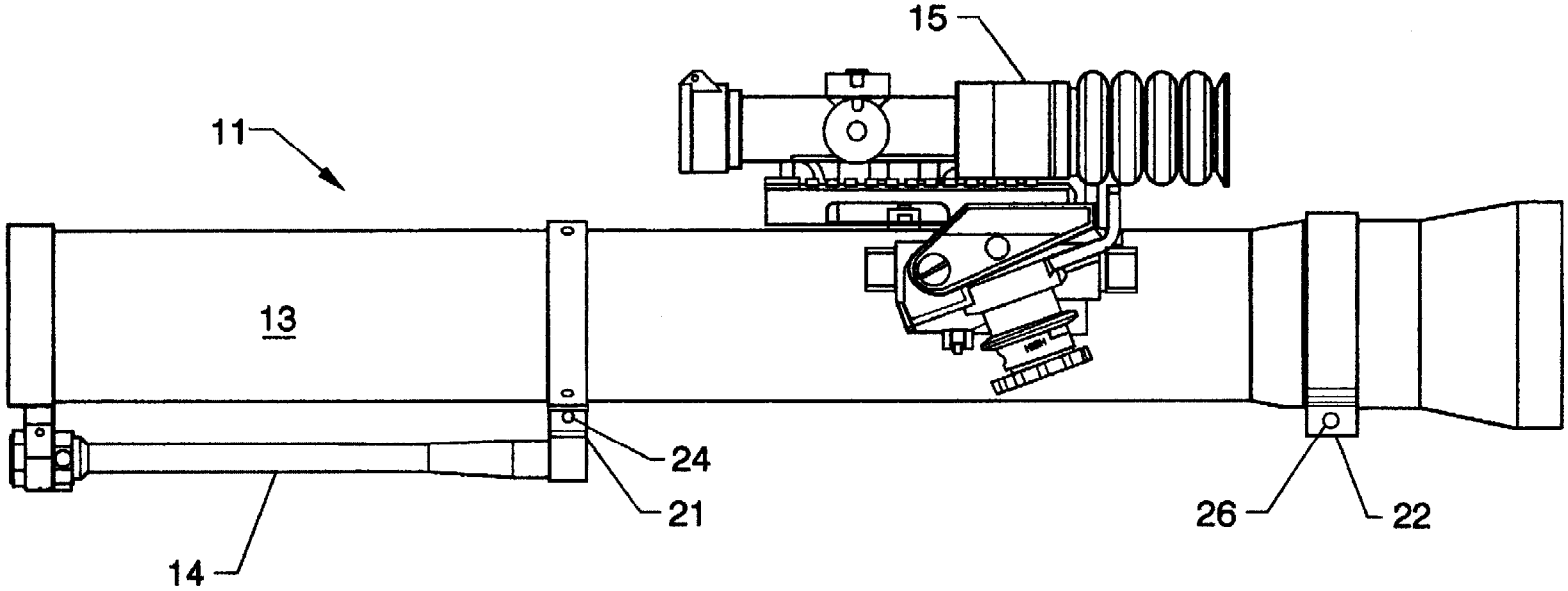
FIG. 2 is a side view of the removable tube and barrel assembly.
Figure 3:
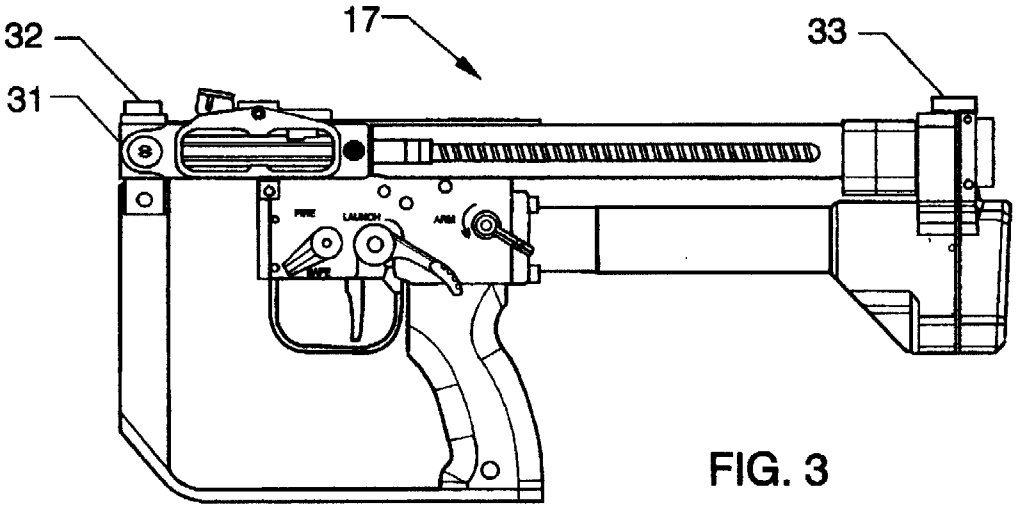
FIG. 3 is a side view of the receiver and trigger assembly group.

Separation of the major subassemblies can be seen in FIGS. 2 and 3. FIG. 2 shows the tube and barrel assembly 11 removed from the receiver and trigger assembly group 17. The sight assembly 15 is shown attached to the rocket launcher tube 13 for reference. Located at the breech end of the spotter rifle barrel 14 is a female dovetail attachment 21 and located near the breech end of the rocket tube 13 is a second female dovetail attachment 22. These attachments slidably engage male dovetail attachments located on the receiver and trigger assembly group 17 as further shown in FIG. 3. Dovetail attachment 21 engages attachment 32 and dovetail attachment 22 engages attachment 33. The spotter rifle barrel 14 slidably mates to the receiver aperature 31. The entire weapon assembly 10 is secured together by setscrews 24 and 26 (shown in FIG. 2). Setscrew 24 secures intermediate clamp ring 29 to the rocket tube 13.

Figure 4:
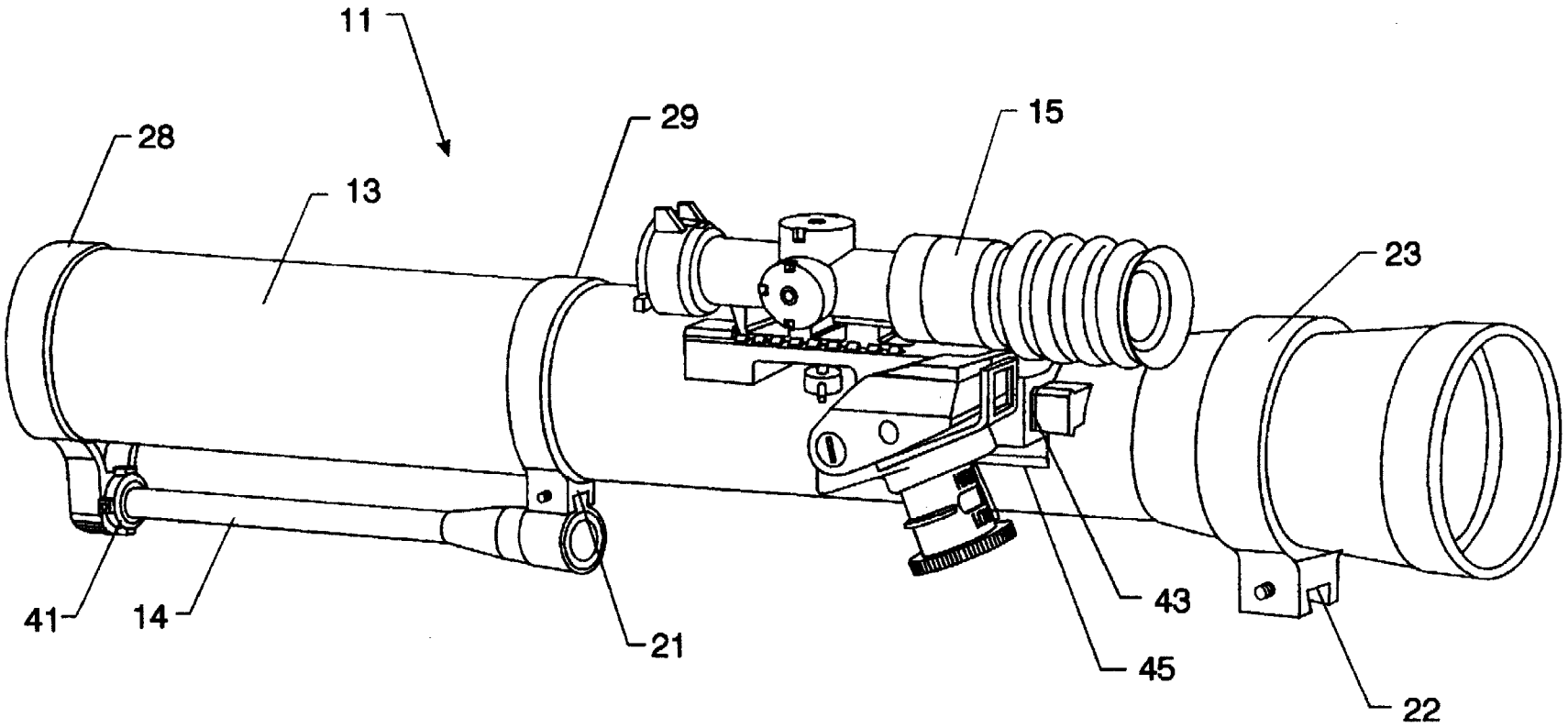
FIG. 4 is a perspective view of the removable tube and barrel assembly.

Referring now to FIG. 4, the removable rocket tube and spotter rifle barrel assembly 11 is shown in perspective with the sight assembly 15 attached. The female fittings of the dovetail are secured to the rocket tube with clamp rings, and in particular, clamp ring 23 at the breech end of the rocket tube and center clamp ring 24 in the middle of the rocket tube. The forward end of spotter rifle barrel 14 is secured to forward rocket tube clamp ring 28 with an adjustable ring 41 which allows re-boresighting of the rifle barrel 14 if necessary. The grouping of the rocket tube and spotter rifle barrel in a single removable assembly allows factory boresighting generally not requiring further adjustment. Because of this feature, it is possible to interchange different caliber rocket launcher tubes with appropriately matched spotter rifles to a common receiver and trigger assembly group. Typically, the preset boresight between the rocket and spotter rifle barrel need not be adjusted during these interchanges. Dovetail fittings 43 are also used on sight assembly 15 mating with a bracket 45 on the rocket launcher tube 13, thereby allowing easy removal of the sight assembly.

Figure 5:
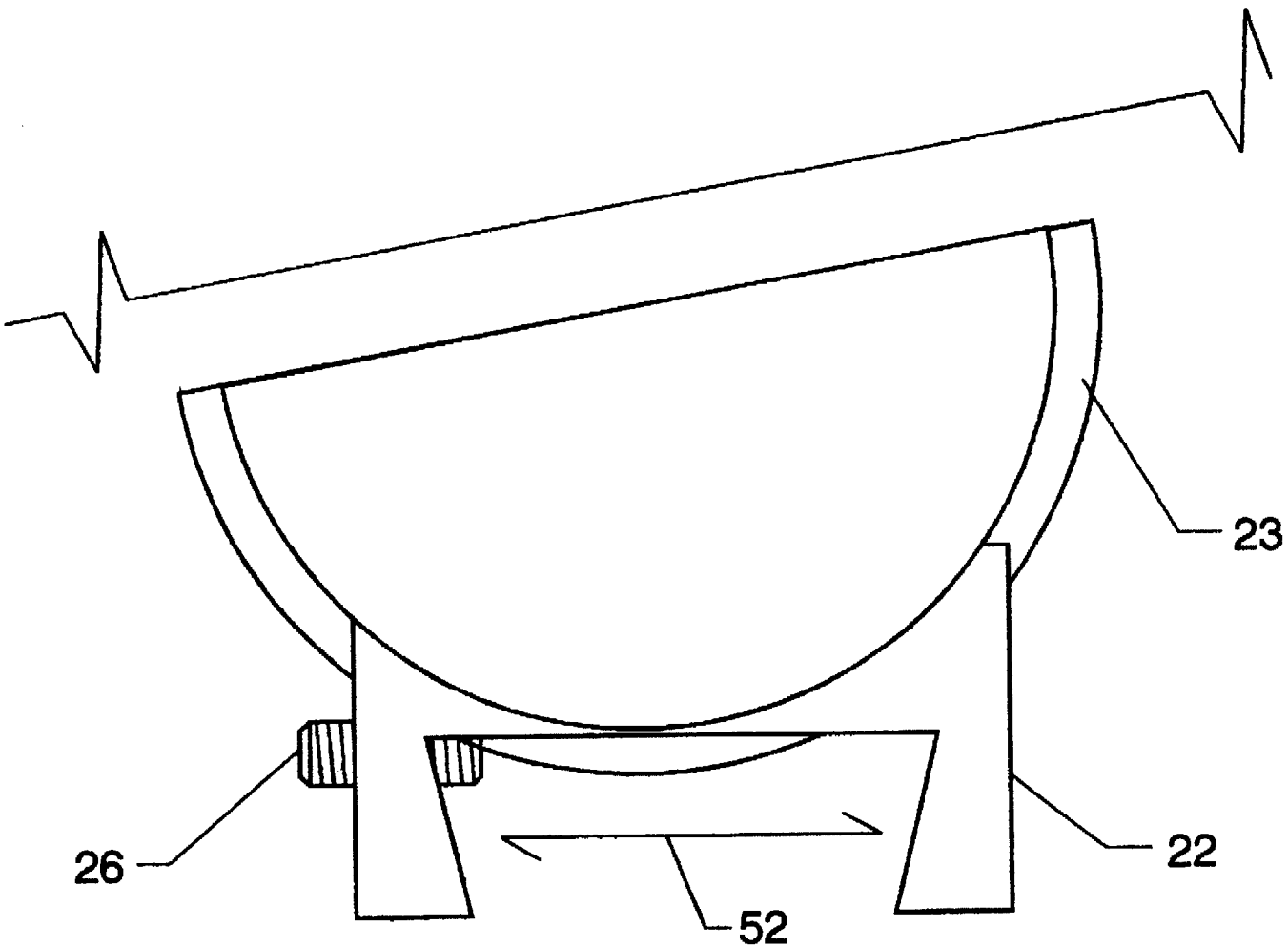
FIG. 5 is an end view of a portion of the tube retaining ring.

Referring now to FIG. 5, a partial cutaway shows the configuration of the female dovetail attachment 22 attached to clamp ring 23. Dovetail fitting 22 is shown engaging the matching attachment from the receiver and trigger assembly group 17. The widened shoulder 52 inside the dovetail fitting 22 allows the tube and barrel assembly 11 to slidably engage the receiver and trigger assembly group 17 as previously depicted.

The benefits and novel features of the present invention are numerous. By grouping the spotter rifle barrel and launcher tube in a single easily removable and replaceable package, the components having the most wear and shortest lifespan in the weapons system can be changed in the field by non-technical personnel. Additionally, different caliber weapons can be quickly assembled with a single receiver and trigger assembly, thereby reducing the number and weight of components to be carried by the weapons operators. Further, factory bore-sighting can be accomplished for different caliber weapons, thereby further expediting the change over or repair of the weapon. Although the invention has been described relative to a specific embodiment thereof, there are numerous variations and modifications that will be readily apparent to those skilled in the art in the light of the above teachings. It is therefore to be understood that, within the scope of the appended claims, the invention may be practiced other than as specifically described.

What is claimed as new and desired to be secured by Letters Patent of the United States is:

1. A shoulder-launched multi-purpose assault weapon comprising:

a receiver and trigger assembly group having male dovetail attachments;

a removable rocket tube and spotter rifle barrel assembly having female dovetail attachments slidably engaging the male dovetail attachments of said receives and trigger assembly group; and a sight assembly attached to said removable rocket tube and spotter rifle barrel assembly.

2. A shoulder-launched multi-purpose assault weapon comprising:

a receiver and trigger assembly group having a plurality of attachments; and a single removable rocket tube and spotter rifle barrel assembly, having a plurality of clamp rings attached thereto said clamp rings having female dovetail fittings slidably engaging the attachments of said receiver and trigger assembly group.

3. A shoulder-launched multi-purpose assault weapon as in claim 2 wherein said plurality of clamp rings include a clamp ring located at a forward end of said rocket tube, said clamping having an adjusting ring attached thereto adapted for securing a forward end of the spotter rifle barrel.

4. A shoulder-launched multi-purpose assault weapon as in claim 2 further comprising a sight assembly attached to said removable rocket tube and spotter rifle barrel assembly.

5. A shoulder-launched multi-purpose assault weapon as in claim 4 wherein said sight assembly further comprises a dovetail attachment for slidably engaging a bracket on said removable rocket tube and spotter rifle barrel assembly.

6. A shoulder-launched multi-purpose assault weapon comprising:

a receiver and trigger assembly group having male dovetail attachments affixed thereto;

a removable tube and barrel assembly further comprising a rocket launcher tube;

a plurality of clamp rings attached to said rocket launcher tube;

a female dovetail attachment affixed to each clamp ring;

an adjustable ring attached to a forward-mounted clamp ring;

a spotter rifle barrel secured to said adjustable ring at a muzzle end and secured to a clamp ring on a breech end; and a sight assembly including a telescopic sight slidably secured to said rocket launcher tube by a dovetail fitting.

* * * * *